US005707560A

United States Patent [19]

Nevin

[11] Patent Number: 5,707,560

[45] Date of Patent: Jan. 13, 1998

[54] CONSTANT VELOCITY CARBURETOR WITH VARIABLE VENTURI SLIDE HAVING BLEED HOLES AT AN OBLIQUE ANGLE AND METHOD OF OPERATION

[75] Inventor: Kenneth A. Nevin, Three Forks, Mont.

[73] Assignee: Dynojet Research, Inc., Belgrade, Mont.

[21] Appl. No.: 695,555

[22] Filed: Aug. 12, 1996

[51] Int. Cl.[6] ..... F02M 9/06

[52] U.S. Cl. ..... 261/44.4

[58] Field of Search ..... 261/44.4

[56] References Cited

U.S. PATENT DOCUMENTS

| | | | |
|---|---|---|---|
| 3,243,167 | 3/1966 | Winkler | 261/44.4 |
| 3,911,063 | 10/1975 | Barnes, Jr. . | |
| 3,949,025 | 4/1976 | Englert et al. . | |
| 3,994,998 | 11/1976 | Mineck . | |
| 4,118,444 | 10/1978 | Abbey . | |
| 4,350,856 | 9/1982 | Abbey . | |
| 4,387,685 | 6/1983 | Abbey . | |
| 4,493,804 | 1/1985 | Nakamura et al. | 261/44.4 |
| 4,530,805 | 7/1985 | Abbey . | |
| 4,574,760 | 3/1986 | Jones et al. . | |

FOREIGN PATENT DOCUMENTS

| | | | |
|---|---|---|---|
| 0107845 | 6/1983 | Japan | 261/44.4 |

*Primary Examiner*—Tim R. Miles
*Attorney, Agent, or Firm*—Allan Jacobson

[57] ABSTRACT

A variable Venturi slide includes a beveled edge at an oblique angle to lower surface of the slide and air flow, and an auxiliary hole having an opening on the beveled edge communicating between the air flow and the interior of the variable Venturi slide. By being located on the beveled edge, the opening of the auxiliary hole is effectively kept out of the high velocity low air pressure air stream at lower air velocities during partial throttle conditions. The auxiliary hole bleeds vacuum from the interior of the variable Venturi slide, picked up by the other lift hole located on the bottom of the slide, and slows the slide lift rate. The slide stays down or rises very slowly under conditions in which a conventional prior art slide would be starting to rise at a linear rate. At higher air velocities, when the throttle plate is opened quickly or operated at near wide open conditions, the opening of the auxiliary hole adds vacuum to the interior of the slide, and increases the slide lift rate. In such manner, the lift rate of the slide is reduced at lower air pressure and velocity, while at the same time, the lift rate of the slide is increased at higher air pressure and velocity. The resulting non-linear lift rate keeps the fuel mixture lean under partial throttle conditions when driving conditions require it, yet provides a ratio of air to fuel mixture that represents the optimum value for the prevailing conditions of engine speed and load throughout a broad range, thereby effecting an improvement in fuel economy and reducing the emission of pollutants.

16 Claims, 5 Drawing Sheets

CONSTANT VELOCITY CARBURETOR WITH VARIABLE VENTURI SLIDE HAVING BLEED HOLES AT AN OBLIQUE ANGLE AND METHOD OF OPERATION

FIELD OF THE INVENTION

The present invention relates to the field of carburetors of the constant velocity type having a variable Venturi slide.

BACKGROUND OF THE INVENTION

The function of a carburetor is to produce the air and fuel mixture needed for the operation of an internal combustion engine. In a typical carburetor, a Venturi tube is used to increase the velocity of air flowing past the orifice of a fuel inlet tube or fuel nozzle. Fuel is introduced in the form of tiny droplets such as may be produced by the shearing forces of a stream of air, the droplets being vaporized as a result of heat absorption in a reduced pressure zone on the way to the combustion chamber.

Carburetors with fixed Venturi dimensions provide the proper dispersion and vaporization effects only over a small part of the operating range of the engine. For this reason, fixed Venturi carburetors require additional idle and low speed jets from passages and parts at or about the throttle plate to maintain fuel flow at lower air flow conditions when Venturi vacuum is insufficient to draw fuel into the Venturi tube.

In contrast, variable Venturi carburetors include a valve of some type to increase or decrease the dimensions of the throat of the Venturi tube in order to provide sufficient vacuum to draw fuel into the Venturi tube over the full operating range of the engine. One type of variable Venturi carburetor, especially applicable to motorcycle and other small gasoline engines, is the slide valve type in which a variable Venturi-slide constricting the throat of the Venturi tube, opens and closes in response to the vacuum or air flow in the Venturi.

A typical variable Venturi slide valve includes a moveable cylindrical plug mounted so as to slide across the Venturi throat perpendicular to the direction of air flow, thereby increasing or decreasing the Venturi throat cross section. At low throttle, the Venturi throat cross sectional area is minimized by the position of the slide (the moveable cylindrical plug). As throttle setting increases, the slide lifts allowing more air through the Venturi throat so as to tend to keep a constant velocity of air flowing through the Venturi throat.

Venturi vacuum is sensed through one or more holes or passages in the lower surface of the slide, which lower surface is parallel to the direction of air flow. The holes are coupled to a generally hollow interior cavity of the slide wherein an elastic diaphragm and spring arrangement biases the slide to close the Venturi throat. The elastic diaphragm and spring arrangement is responsive to the vacuum in the interior cavity of the slide to compress the spring and move the slide to open the Venturi throat. The slide is thus responsive to the sensed Venturi vacuum to move to a position so as to provide substantially constant velocity and constant vacuum in the Venturi throat section. As the throttle plate is moved by the operator, the volume of the incoming air moves the slide in response thereto so as to provide the proper mixture of air and fuel.

However, when the throttle is operated quickly or at near wide open conditions, the response of the slide (the lift rate) affects performance, fuel economy and emissions. The lift rate of the slide which is generally linear, is in turn related to the size (cross sectional area) of the holes in its lower surface. For good economy, the holes are kept small so that the slide responds slowly to the increase in volume of incoming air. While small holes provide good economy, the resulting slow lift rate provides poor performance in response to the throttle. For good performance, bigger holes or more holes are added, which allows the slide to lift quickly (i.e., provide more rapid vacuum effect in the interior of the slide for a faster lift). While larger holes provide good performance, the resulting rapid lift rate provides poor fuel economy and increased output of noxious emissions, such as carbon monoxide, particularly at low and mid range throttle conditions.

SUMMARY OF THE INVENTION

In a constant velocity carburetor in accordance with the present invention, a variable Venturi slide moves slowly under low throttle conditions, yet moves quickly when the throttle plate is opened quickly or operated at near wide open conditions.

In particular, a variable Venturi slide in accordance with the present invention includes a beveled edge at an oblique angle to the lower surface of the slide. The beveled edge further includes an auxiliary opening communicating between the air flow and the interior of the variable Venturi slide.

At lower air velocities, the auxiliary opening bleeds vacuum from the interior of the variable Venturi slide, thereby slowing the variable Venturi slide lift rate. At higher air velocities, the auxiliary opening adds vacuum to the interior of the variable Venturi slide, thereby increasing the variable Venturi slide lift rate.

By being located on the beveled edge, the auxiliary hole is effectively kept out of the high velocity, low air pressure air stream during partial throttle conditions. This allows the auxiliary hole to bleed vacuum picked up by the other lift hole located on the bottom of the slide. By bleeding initial vacuum, the slide stays down or rises very slowly under conditions in which a conventional prior art slide would be starting to rise at a linear rate. The resulting lower lift rate keeps the fuel mixture lean when driving conditions require it.

When the throttle plate is opened quickly or at near wide open conditions, the demand for air is greatly increased. Air is being pulled from all around the slide and the auxiliary holes that were once out of the high velocity air stream and bleeding vacuum, are now in the air stream and adding vacuum. The slide lift rate is suddenly increased to a level even higher than that of a conventional prior art slide.

Thus, at lower air pressure and velocity, the lift rate of the slide is reduced, while at the same time, at higher air pressure and velocity, the lift rate of the slide is increased. In such manner, instead of the best compromise hole size selection, the variable Venturi slide of the present invention permits the lift rate of the slide to match the engine's needs substantially throughout the full operating range of the engine, thereby increasing both performance and economy.

DETAILED DESCRIPTION

Figure 1:
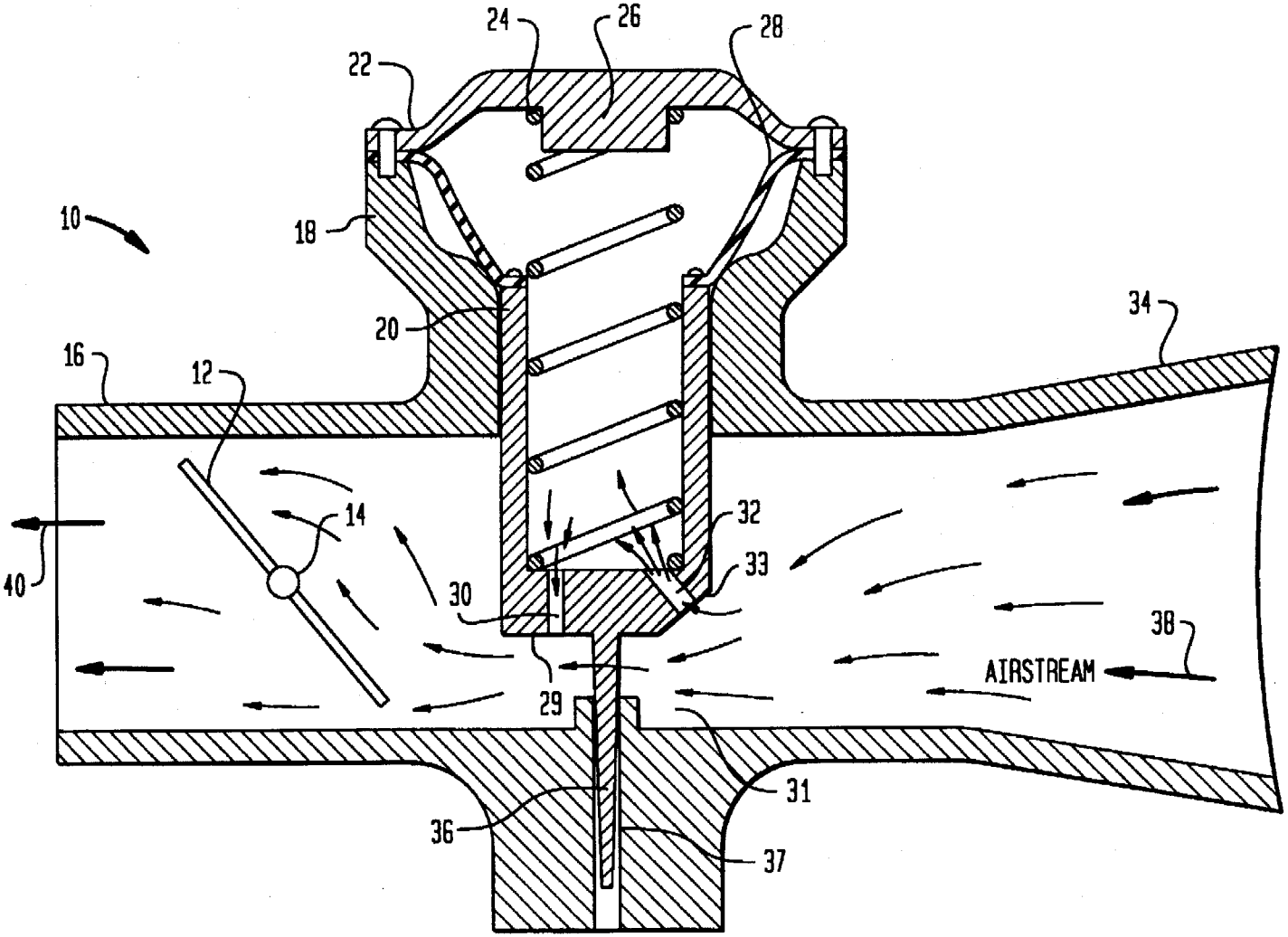
FIG. 1 is a constant velocity carburetor with a variable Venturi slide having bleed holes at an oblique angle in accordance with the present invention illustrating operation at low or partial throttle conditions.

A constant velocity carburetor 10 with a variable Venturi slide 20 is shown schematically in FIG. 1. The carburetor 10 includes a converging portion 34 open at one end to receive air from a conventional air filter (not shown) at essentially atmospheric pressure level, and an exit portion 16 which is adapted to be connected to the intake manifold of an internal combustion engine, not shown. Between the converging portion 34 which forms an input passage, and the exit portion 16 which forms an output passage, is an interior passage which includes a Venturi tube section having a narrow portion therein forming a Venturi throat.

A throttle plate 12 is fixed on a shaft 14 that is mounted in carburetor 10 for rotation across exit portion 16 to control the flow through the passage. The operator controls the position of throttle plate 12 between essentially closed engine idle speed and a wide open throttle position.

A hollow cylindrical plug 20 is movably mounted to slide within a cylindrical channel formed by vertical walls 18. The hollow slide 20, is open at one end and attached to the inner edge of an elastic diaphragm 28 having a generally annular shape. The outer edge of the annular elastic diaphragm 28 is compressed between vertical walls 18 and a cap 22 to provide an airtight seal. The cap 22 further includes a protrusion 26 for retaining one end of a spring 24. The other end of the spring 24 is disposed within and seated at the bottom of the hollow interior of slide 20.

Figure 2:
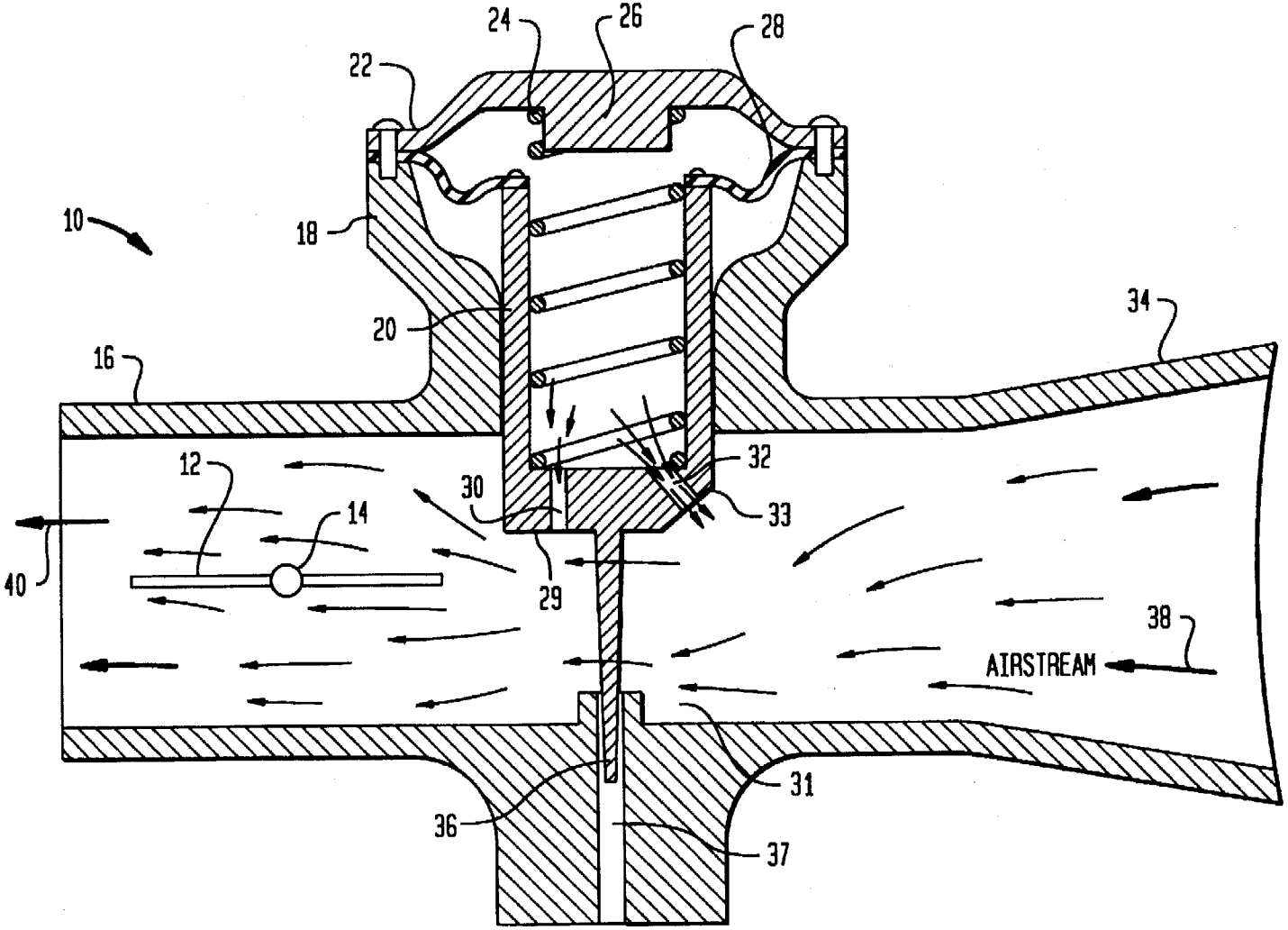
FIG. 2 is a constant velocity carburetor with a variable Venturi slide having bleed holes at an oblique angle in accordance with the present invention illustrating operation at full throttle conditions.

The slide 20 is attached at the lower end to a tapered needle 36 which is inserted into the orifice of fuel tube 37 to vary the amount of fuel allowed to pass into the engine. Spring 24 is selected to bias the slide 20 to its fully extended position for which the cross sectional area of the Venturi throat region 31 is at a minimum. FIG. 1 shows the position of the slide 20 for low or partial throttle conditions, while FIG. 2 shows the position of the slide 20 for full throttle conditions.

Figure 3:
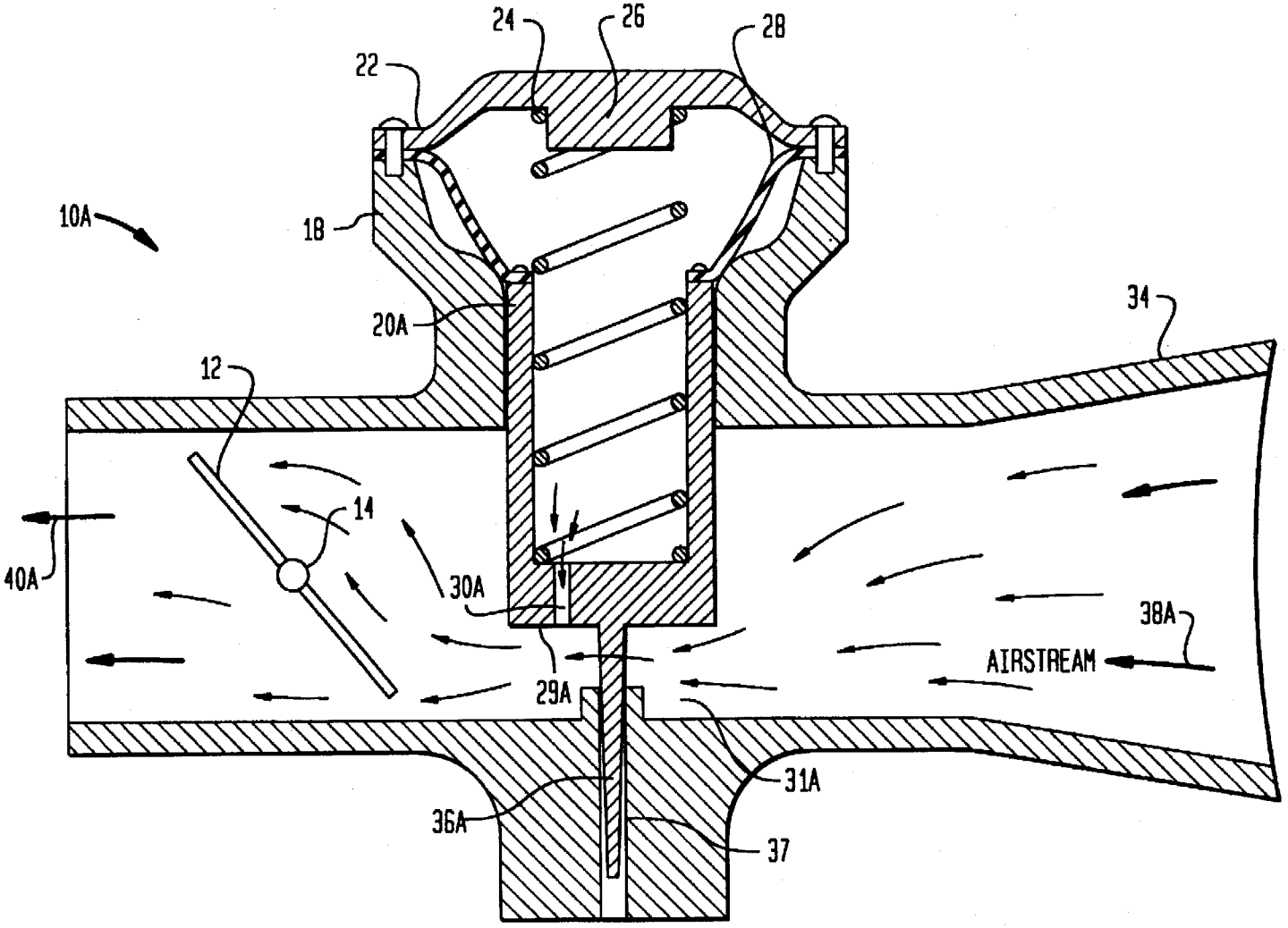
FIG. 3 (PRIOR ART)
FIG. 3 is a conventional constant velocity carburetor operated at low or partial throttle conditions, and having a conventional variable Venturi slide with vacuum holes.

To better understand of the operation of the moveable slide of the present invention, it is useful to review the operation of the prior art moveable slide 20A as shown in FIG. 3. As in FIGS. 1 and 2, the above, the slide 20A in FIG. 3 is attached at the lower end to a tapered needle 36A which is inserted into the orifice of fuel tube 37 to vary the amount of fuel allowed to pass into the engine. Also similar, spring 24 is selected to bias the slide 20A to its fully extended position in which the cross sectional area of the Venturi throat region 31A is at a minimum.

Venturi vacuum is sensed through the opening of hole 30A in the lower surface 29A of the slide, which lower surface is parallel to the direction of air flow 38A. Hole 30A senses the vacuum (air pressure) in the Venturi throat region 31A by coupling the Venturi throat region 31A to the hollow interior of the variable Venturi slide 20A. The slide 20A responds to the increase or decrease in the sensed vacuum to expand or compress the interior volume of the slide and spring assembly, and thereby move the slide to a position so as to decrease or increase the cross sectional area of the Venturi throat region 31A, respectively.

At low or partial throttle conditions, input air 38A is drawn into the converging portion 34 of the carburetor 10A. The air increases in velocity as it passes through the Venturi throat region 31A, where it gives up the energy gained in velocity by reducing its temperature and pressure. The reduced pressure pulls a vacuum through hole 30A of slide 20A. The interior volume enclosed by hollow slide 20A, annular elastic diaphragm 28 and cap 22, is thereby reduced, compressing spring 24 and lifting slide 20A. As slide 20A lifts, the cross sectional area of Venturi throat region 31A increases, and the air pressure in the Venturi throat is reduced. At the same time spring 24, is compressed, increasing the downward bias on slide 20A. The process continues until equilibrium at a new slide position is reached.

Also, as with any classical Venturi carburetor, the reduced pressure and increased velocity of the air in the Venturi throat region 31A draws fuel from fuel tube 37 into to the air stream to form a fuel and air mixture 40A for the internal combustion engine. It is desirable to provide a substantially constant vacuum and constant velocity through the Venturi tube for each condition of engine speed and load over the full operating range of the engine.

Increases in engine speed and load are exhibited by changes in the demand for air flow. The speed at which the slide 20A adjusts to changes in demand for air flow affects the responsiveness and performance of the motorcycle or other vehicle. For better performance, a faster slide response is desirable. A faster slide 20A can be achieved by increasing the size of hole 30A or adding more holes in the lower surface 29A of slide 20A.

Increased or added holes improves performance at the expense of fuel economy and emissions control. In particular for larger holes, the slide responds with an increased lift rate, but still generally constant (i.e., linear) lift rate over its operating range. At low or partial throttle, the lift rate of the slide response is too fast for good economy and emissions, while for rapid throttle changes at near wide open conditions, the same lift rate of the slide is too slow for good performance.

The arrangement of the present invention provides a slower slide lift rate at low or partial throttle conditions as in FIG. 1, and a higher slide lift rate for rapid throttle changes at near wide open conditions as in FIG. 2, thereby achieving both good fuel economy with lower emissions, and improved engine performance. The different lift rates are achieved by providing one or more auxiliary holes to the interior of the slide 20 (FIG. 1) through a beveled surface 33 at an oblique angle 33A (from FIG. 5) to the lower surface 29 of the slide and to the air flow 38 (FIG. 1). The beveled surface 33 forms a leading edge on the slide 20, i.e., an edge which substantially faces the air flow 38. The operation of auxiliary hole 32 through beveled surface 33 is explained with reference to FIGS. 1 and 2 which illustrate low throttle and high throttle conditions respectively.

In FIG. 1, vacuum is sensed through opening 30 in the lower surface 29 of the slide 20, which lower surface is parallel to the direction of air flow, and communicating the vacuum from the air flow in the Venturi throat region 31 to the hollow interior of the variable Venturi slide 20. As before, the slide 20 is responsive to an increase in the sensed vacuum to compress the spring 24 and the interior volume, and thereby move to a position so as to increase the Venturi throat cross sectional region 31. However, the opening of auxiliary hole 32 is out of the high velocity low pressure air stream during low throttle conditions. Since beveled surface 33 partially faces the air flow 38, (and the axis of the channel of hole 32 to the interior of slide 20 is also at an oblique angle to the air flow 38) hole 32 actually bleeds some of the vacuum from the interior of slide 20 provided through hole 30. Thus, at low throttle conditions, the presence of hole 32 on beveled edge 33 reduces the lift rate of slide 20 as compared to that of the prior art slide.

Specifically, input air 38 is drawn into the converging portion 34 of the carburetor 10. The air increases in velocity as it passes through the Venturi throat region 31 thereby reducing its pressure. The reduced pressure pulls a vacuum through hole 30 of slide 20. Hole 32 bleeds some of the vacuum produced through hole 30. The vacuum in the interior volume enclosed by hollow slide 20, annular elastic diaphragm 28 and cap 22, is thereby reduced, compressing spring 24 and lifting slide 20, but at a slower rate. The slide lift rate is decreased to a level even lower than linear lift rate of a conventional slide. As slide 20 lifts, the cross sectional area of Venturi throat region 31 increases, until equilibrium at a new slide position is reached.

Also, as before, the reduced pressure and increased velocity of the air in the Venturi throat region 31 draws fuel from fuel tube 37 into to the air stream to form a fuel and air mixture 40 for the internal combustion engine.

An increase in demand for engine speed and engine load are exhibited by an increase in the demand for air flow. FIG. 2 illustrates a rapid change in throttle setting or a near full throttle condition. Air is pulled from all around the slide 20, and the opening of auxiliary hole 32 which was once out of the high velocity air stream bleeding vacuum is now in the stream adding vacuum to the interior volume enclosed by hollow slide 20. The slide lift rate is suddenly increased to even higher than that of a conventional slide, responding faster than a linear lift rate.

Figure 4:
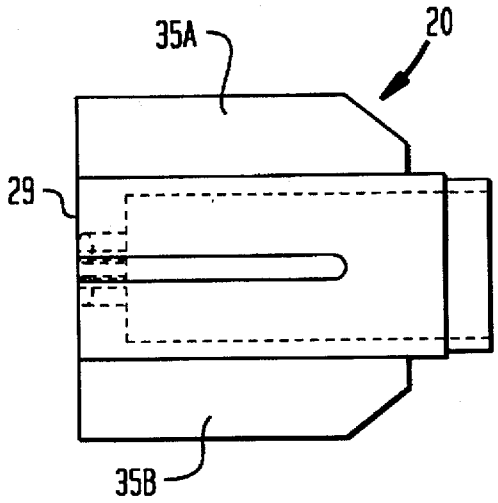
FIG. 4 is a front top view of a variable Venturi slide having bleed holes at an oblique angle in accordance with the present invention.
Figure 6:
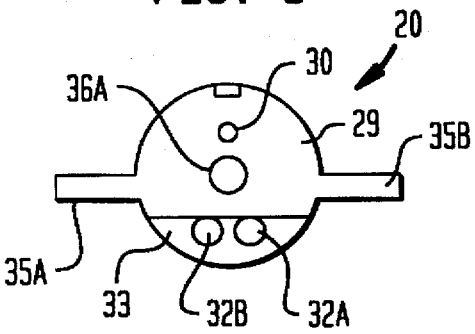
FIG. 6 is a bottom view of a variable Venturi slide having bleed holes at an oblique angle in accordance with the present invention.
Figure 5:
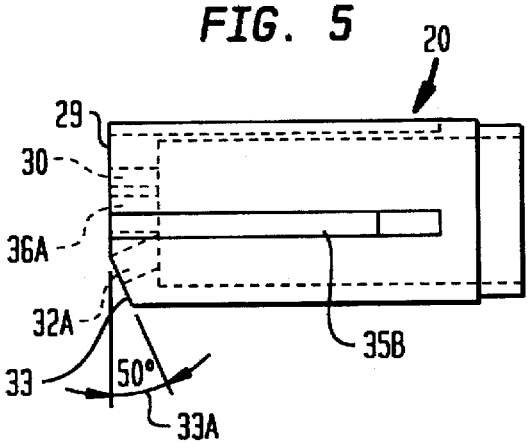
FIG. 5 is a side view of a variable Venturi slide having bleed holes at an oblique angle in accordance with the present invention.

Details on the construction of the slide 20 in accordance with the present invention are shown in FIGS. 4, 5 and 6. Flanges 35A and 35B provide the means for a slidable mounting of slide 20. Vacuum hole 30 is provided in the bottom of slide 20. A hole 36A is provided for receiving tapered needle 36 (not shown in FIGS. 4, 5 and 6).

Two auxiliary holes 32A and 32B are shown having openings on a beveled edge 33. Beveled edge 33 is shown at a 50 degree oblique angle 33A to the lower surface 29, with the axis of holes 32A and 32B at 90 degrees to the beveled edge 33. The angle 33A of the beveled edge 33 effects the balance between bleeding vacuum and adding vacuum. Other placements of auxiliary holes having openings on surfaces at different oblique angles to the lower surface 29 of the slide and air flow will achieve a similar effect. In general, the larger the angle of the beveled edge, the greater the effect caused by the auxiliary holes. In particular, the larger the angle of the beveled edge, the greater the bleeding of initial vacuum and the slower the initial rise of the slide. However, the larger the angle of the beveled edge, the higher the air velocity required for crossover from bleeding vacuum to adding vacuum. Therefore, choice of a beveled edge angle is a compromise between slowing the initial rise of the slide or speeding the full throttle response of the slide.

As indicated above, two auxiliary holes 32A and 32B are as shown openings on beveled edge 33 at a 50 degree oblique angle 33A to the lower surface 29. The auxiliary holes 32A and 32B are also channels to the interior of the slide 20, where each channel has an axis perpendicular to the beveled edge 33. Therefore, the axis of each of the auxiliary holes 32A and 32B, is also at an oblique angle to the lower surface 29, in this case 40 degrees. Alternatively, the axis of the channel through to the interior of slide 20 may also be at an oblique angle with respect to the beveled edge 33. Other placements of auxiliary holes forming channels at oblique angles to the lower surface 29 of the slide and air flow will achieve a similar effect.

The angle of the axis of the channels of holes 32A and 32B also effects the balance between bleeding vacuum and adding vacuum. In general, the smaller the oblique angle of the axis of the channel, the greater the effect caused by the auxiliary holes. In particular, the smaller the angle of the axis of the channel, the greater the bleeding of initial vacuum and the slower the initial rise of the slide. However, the smaller the angle of the axis of the channel, the higher the air velocity required for crossover from bleeding vacuum to adding vacuum. Therefore, choice of a channel axis angle is a compromise between slowing the initial rise of the slide and speeding up its full throttle response.

Figure 7:
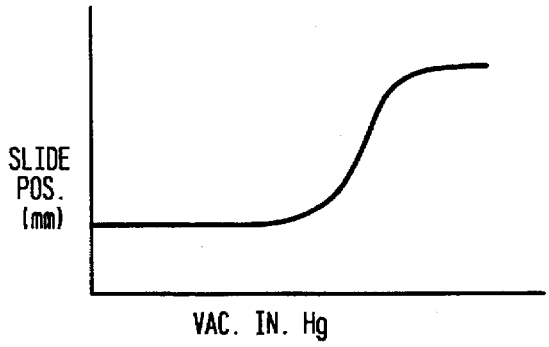
FIG. 7 is a graphical representation of slide position versus vacuum for a variable Venturi slide having bleed holes at an oblique angle in accordance with the present invention.
Figure 8:
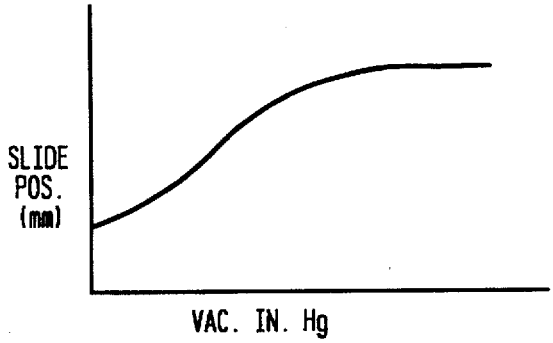
FIG. 8 (PRIOR ART)
FIG. 8 is a graphical representation of slide position versus vacuum for a conventional slide known in the prior art.
Figure 9:
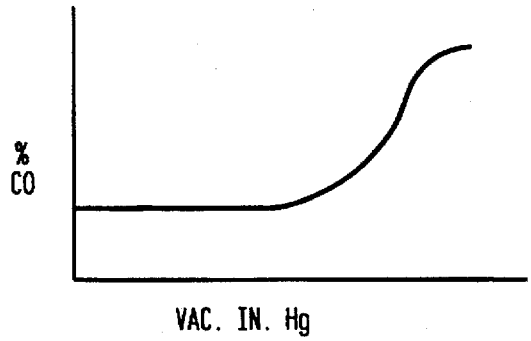
FIG. 9 is a graphical representation of vacuum measured at the intake manifold, versus percentage of carbon monoxide engine emissions for a variable Venturi slide having bleed holes at an oblique angle in accordance with the present invention.
Figure 10:
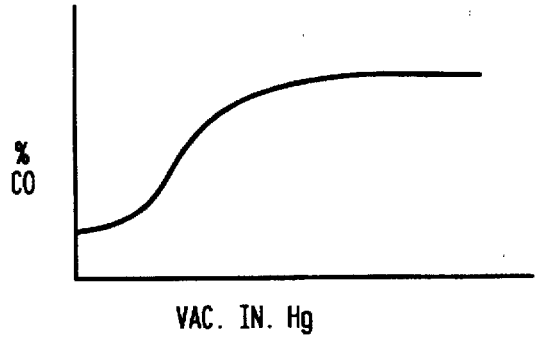
FIG. 10 (PRIOR ART)
FIG. 10 is a graphical representation of vacuum measured at the intake manifold, versus percentage of carbon monoxide engine emissions for a conventional slide known in the prior art.

Performance curves illustrate the effect of the present invention (FIGS. 7 and 9) compared to the prior art (FIGS. 8 and 10). As shown in FIG. 8, the slide position versus Venturi vacuum for a stock slide rises generally linearly especially for low vacuum conditions. In comparison, the slide position for the present invention in FIG. 7 rises very slowly for lower vacuum conditions and very rapidly for higher vacuum conditions. The slow initial rise provides for fuel economy at idle and partial throttle conditions, while the rapid rise for rapid throttle changes or near full throttle conditions provides for responsive performance.

The variable Venturi slide of the present invention also reduces the emissions of carbon monoxide as compared to the prior art slide. As shown in FIG. 10, the percentage of carbon monoxide versus Venturi vacuum for a stock slide rises generally linearly especially for low vacuum conditions and approaches a maximum at mid range vacuum conditions. In comparison, the percentage of carbon monoxide as shown in FIG. 7 for the present invention, rises very slowly for low vacuum conditions and finally increases to a maximum only for the higher vacuum conditions.

Thus, a variable Venturi slide in accordance with the present invention provides for responsive performance at rapidly changing or full throttle conditions, while keeping emission of carbon monoxide low for idle and partial throttle conditions.

What is claimed is:

1. A carburetor having an interior passage including a Venturi tube section for forming a mixture of fuel and air, said interior passage including an input passage at one end adapted for receiving input air, and an output passage at the other end adapted for coupling said mixture of fuel and air to an engine intake manifold, said interior passage of said carburetor including said Venturi tube section further having a narrow portion therein forming a Venturi throat region, and a valve for varying the cross sectional area of said Venturi throat region, said carburetor comprising:

a slide having a generally hollow interior cavity therein, said slide mounted so to slide across said Venturi throat region substantially perpendicularly to the direction of air flow through said Venturi throat region;

said slide having a first surface substantially parallel to said air flow;

said slide having an opening in said first surface substantially parallel to said air flow, said opening communicating with said interior cavity of said slide, said slide being responsive to the air flow in said Venturi throat region through said opening to move said slide so as to increase and decrease the cross sectional area of said Venturi throat region;

said slide having a second surface formed at oblique angle to said first surface; and said second surface having an opening therethough to said interior cavity of said slide.

2. An apparatus in accordance with claim 1, wherein said second surface on said slide is a beveled surface forming a leading edge of said slide facing said air flow.

3. An apparatus in accordance with claim 1, wherein said second surface a beveled surface substantially at a 50 degree angle with respect to said first surface.

4. An apparatus in accordance with claim 1, wherein said opening in said second surface communicates with said interior cavity of said slide through a channel, and wherein the axis of said channel is disposed at an oblique angle to said first surface.

5. In a carburetor having an interior passage including a Venturi tube section, said interior passage including an input passage at one end adapted for receiving input air, and an output passage at the other end adapted for coupling a mixture of fuel and air to an engine intake manifold, said interior passage of said carburetor including said Venturi tube section further having a narrow portion therein forming a Venturi throat region, and a valve for varying the cross sectional area of said Venturi throat region, said valve further comprising an interior cavity therein, said valve mounted so to move across the direction of air flow through said Venturi throat region, said valve having a first surface including an opening communicating with said air flow in said Venturi throat region, said opening further communicating with said interior cavity, said valve being responsive to the vacuum in said Venturi throat region through said opening to move said valve, thereby increasing and decreasing the cross sectional area of said Venturi throat region, an improvement comprising:

a second surface formed on said valve, said second surface being formed at oblique angle to said first surface; and an opening in said second surface for communicating therethough to, said interior cavity.

6. An apparatus in accordance with claim 5, wherein said second surface on said slide is a beveled surface forming a leading edge of said slide facing said air flow.

7. An apparatus in accordance with claim 5, wherein said second surface a beveled surface substantially at a 50 degree angle with respect to said first surface.

8. An apparatus in accordance with claim 5, wherein said opening in said second surface communicates with said interior cavity of said slide through a channel, and wherein the axis of said channel is disposed at an oblique angle to said first surface.

9. A carburetor having an interior passage including a Venturi tube section for forming a mixture of fuel and air, said interior passage including an input passage at one end adapted for receiving input air, and an output passage at the other end adapted for coupling said mixture of fuel and air to an engine intake manifold, said interior passage of said carburetor including said Venturi tube section further having a narrow portion therein forming a Venturi throat region, and a valve for varying the cross sectional area of said Venturi throat region, said carburetor comprising:

a slide having a generally hollow interior cavity therein, said slide mounted so to slide across said Venturi throat region substantially perpendicularly to the direction of air flow through said Venturi throat region;

said slide having a first surface substantially parallel to said air flow;

said slide having an opening in said first surface substantially parallel to said air flow, said opening communicating with said interior cavity of said slide, said slide being responsive to the air flow in said Venturi throat region through said opening to move said slide so as to increase and decrease the cross sectional area of said Venturi throat region;

said slide having an auxiliary hole therethrough, said auxiliary hole having an opening communicating with said Venturi tube section and a channel to said interior cavity of said slide;

said opening of said auxiliary hole being formed at first oblique angle to said first surface; and said axis of said auxiliary hole being formed at second oblique angle to said first surface.

10. An apparatus in accordance with claim 9, wherein said opening of said auxiliary hole to said interior cavity of said slide includes an opening on a beveled surface forming a leading edge of said slide facing said air flow.

11. An apparatus in accordance with claim 9, wherein the axis of said channel is substantially at a 40 degree angle with respect to said first surface.

12. In a carburetor having an interior passage including a Venturi tube section, said interior passage including an input passage at one end adapted for receiving input air, and an output passage at the other end adapted for coupling a mixture of fuel and air to an engine intake manifold, said interior passage of said carburetor including said Venturi tube section further having a narrow portion therein forming a Venturi throat region, and a valve for varying the cross sectional area of said Venturi throat region, said valve further comprising an interior cavity therein, said valve mounted so to move across the direction of air flow through said Venturi throat region, said valve having a first surface including an opening communicating with said air flow in said Venturi throat region, said opening further communicating with said interior cavity, said valve being responsive to the vacuum in said Venturi throat region through said opening to move said valve, thereby increasing and decreasing the cross sectional area of said Venturi throat region, an improvement comprising:

said slide having an auxiliary hole therethrough, said auxiliary hole having an opening communicating with said Venturi tube section and a channel to said interior cavity of said slide;

said opening of said auxiliary hole being formed at first oblique angle to said first surface; and said axis of said auxiliary hole being formed at second oblique angle to said first surface.

13. An apparatus in accordance with claim 12, wherein said opening of said auxiliary hole to said interior cavity of said slide includes an opening on a beveled surface forming a leading edge of said slide facing said air flow.

14. An apparatus in accordance with claim 12, wherein the axis of said channel is substantially at a 40 degree angle with respect to said first surface.

15. In a carburetor having an interior passage including a Venturi tube section for forming a mixture of fuel and air, said interior passage including an input passage at one end adapted for receiving input air, and an output passage at the other end adapted for coupling said mixture of fuel and air to an engine intake manifold, said interior passage of said carburetor including said Venturi tube section further having a narrow portion therein forming a Venturi throat region, and a slide valve for varying the cross sectional area of said Venturi throat region, said slide valve having a generally hollow interior cavity therein, said slide mounted so to slide across said Venturi throat region substantially perpendicularly to the direction of air flow through said Venturi throat region, a method for positioning said slide valve comprising:

sensing vacuum in said Venturi throat to form a sensed vacuum;

positioning said slide responsive to said sensed vacuum;

sensing the air flow into said Venturi throat to from a sensed air flow;

reducing said sensed vacuum to bleed vacuum from said sensed vacuum by combining said sensed air flow with said sensed vacuum at a first air flow rate; and increasing said sensed vacuum to add vacuum to said sensed vacuum by adding said sensed air flow to said sensed vacuum at a second air flow rate, wherein said second air flow rate is higher than said first air flow rate;

whereby said slide valve opens at a first lift rate at said first air flow rate, and opens at a second lift rate at said second air flow rate, wherein said second lift rate is greater than said first lift rate.

16. In a carburetor having an interior passage including a Venturi tube section, said interior passage including an input passage at one end adapted for receiving input air, and an output passage at the other end adapted for coupling a mixture of fuel and air to an engine intake manifold, said interior passage of said carburetor including said Venturi tube section further having a narrow portion therein forming a Venturi throat region, and a valve for varying the cross sectional area of said Venturi throat region, said valve further comprising an interior cavity therein, said valve mounted so to move across the direction of air flow through said Venturi throat region, said valve having a first surface including an opening communicating with said air flow in said Venturi throat region, said opening further communicating with said interior cavity, said valve being responsive to the vacuum in said Venturi throat region through said opening to move said valve, thereby increasing and decreasing the cross sectional area of said Venturi throat region, wherein a method for positioning said valve comprises sensing vacuum in said Venturi throat through said opening to form a sensed vacuum, and positioning said valve responsive to said sensed vacuum, an improved method for positioning said valve, said improvement comprising:

sensing the air flow into said Venturi throat to from a sensed air flow;

reducing said sensed vacuum to bleed vacuum from said sensed vacuum by combining said sensed air flow with said sensed vacuum at a first air flow rate; and increasing said sensed vacuum to add vacuum to said sensed vacuum by adding said sensed air flow to said sensed vacuum at a second air flow rate, wherein said second air flow rate is higher than said first air flow rate;

whereby said valve opens at a first lift rate at said first air flow rate, and opens at a second lift rate at said second air flow rate, wherein said second lift rate is greater than said first lift rate.

* * * * *